US011193080B2

(12) United States Patent
Sunahara et al.

(10) Patent No.: US 11,193,080 B2
(45) Date of Patent: Dec. 7, 2021

(54) LUBRICATING OIL COMPOSITION

(71) Applicants: IDEMITSU KOSAN CO., LTD., Chiyoda-ku (JP); TOYOTA JIDOSHA KABUSHIKI KAISHA, Toyota (JP)

(72) Inventors: Kenji Sunahara, Ichikawa (JP); Toyoharu Kaneko, Anjo (JP); Kazuo Yamamori, Nagoya (JP)

(73) Assignees: IDEMITSU KOSAN CO., LTD., Chiyoda-ku (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/826,711

(22) Filed: Mar. 23, 2020

(65) Prior Publication Data

US 2020/0308503 A1 Oct. 1, 2020

(30) Foreign Application Priority Data

Mar. 29, 2019 (JP) ..... JP2019-067657

(51) Int. Cl.

| | |
|---|---|
| ***C10M 135/18*** | (2006.01) |
| ***C10M 129/68*** | (2006.01) |
| ***C10M 129/16*** | (2006.01) |
| ***C10M 133/04*** | (2006.01) |
| ***C10M 129/32*** | (2006.01) |
| ***C10M 129/44*** | (2006.01) |
| *C10N 10/04* | (2006.01) |
| *C10N 10/12* | (2006.01) |
| *C10N 20/02* | (2006.01) |
| *C10N 30/02* | (2006.01) |
| *C10N 40/25* | (2006.01) |

(52) U.S. Cl.

CPC ..... *C10M 135/18* (2013.01); *C10M 129/16* (2013.01); *C10M 129/32* (2013.01); *C10M 129/44* (2013.01); *C10M 129/68* (2013.01); *C10M 133/04* (2013.01); *C10M 2219/068* (2013.01); *C10N 2010/04* (2013.01); *C10N 2010/12* (2013.01); *C10N 2020/02* (2013.01); *C10N 2030/02* (2013.01); *C10N 2040/25* (2013.01)

(58) Field of Classification Search

CPC ..... C10M 2207/023; C10M 2205/173; C10M 2207/026; C10M 2207/262; C10M 2209/084; C10M 2215/28; C10M 2219/046; C10M 2219/068; C10M 2223/045; C10N 2010/04; C10N 2010/12; C10N 2040/25; C10N 2030/041

See application file for complete search history.

(56) References Cited

U.S. PATENT DOCUMENTS

| | | | |
|---|---|---|---|
| 5,658,862 | A | 8/1997 | Vrahopoulou |
| 5,906,969 | A | 5/1999 | Fyfe |
| 2003/0176297 | A1 | 9/2003 | Hartley et al. |
| 2008/0234153 | A1 | 9/2008 | Matsui |
| 2009/0082233 | A1 | 3/2009 | Kasai |
| 2012/0270693 | A1 | 10/2012 | Ando et al. |
| 2015/0005208 | A1 | 1/2015 | Yaguchi et al. |
| 2015/0045271 | A1 | 2/2015 | Yoshida |
| 2016/0348027 | A1 | 12/2016 | Utaka |
| 2017/0158982 | A1 | 6/2017 | Tamura et al. |
| 2017/0138235 | A1 | 7/2017 | Kusumoto |
| 2017/0198235 | A1* | 7/2017 | Kusumoto ..... C10M 163/00 |

(Continued)

FOREIGN PATENT DOCUMENTS

| | | |
|---|---|---|
| EP | 2 610 333 | 7/2013 |
| EP | 3 495 463 | 6/2019 |
| JP | 59-122597 | 7/1984 |
| JP | 1-201398 | 8/1989 |
| JP | H 10-183154 | 7/1998 |
| JP | 2000-001690 | 1/2000 |
| JP | 2003-253288 | 9/2003 |
| JP | 2005-263830 | 9/2005 |
| JP | 2006-328265 | 12/2006 |
| JP | 2007-217604 | 8/2007 |
| JP | WO 2011/062282 A1 | 5/2011 |

(Continued)

OTHER PUBLICATIONS

Office Action dated Mar. 18, 2020, in U.S. Appl. No. 16/320,811.

(Continued)

*Primary Examiner* — Vishal V Vasisth

(74) *Attorney, Agent, or Firm* — Oblon, McClelland, Maier & Neustadt, L.L.P.

(57) ABSTRACT

The present invention relates to a lubricating oil composition containing a base oil (A), a molybdenum dithiocarbamate (B), an ester-based ashless friction modifier (C), and a metal salicylate (D), wherein the content of a molybdenum atom derived from the molybdenum dithiocarbamate (B) is 650 ppm by mass or more on the basis of the whole amount of the lubricating oil composition; a content ratio [$C/B_{Mo}$] of the ester-based ashless friction modifier (C) to a molybdenum atom derived from the molybdenum dithiocarbamate (B) is 5.0 to 10 in terms of a mass ratio; the content of a salicylate soap group derived from the metal salicylate (D) is 0.50% by mass or more on the basis of the whole amount of the lubricating oil composition; and a kinematic viscosity at 100° C. is 4.0 $mm^2/s$ or more and less than 9.3 $mm^2/s$, and a high-temperature high-shear viscosity at 150° C. is 1.7 mPa·s or more and less than 2.9 mPa·s. In accordance with the present invention, a viscosity-reduced lubricating oil composition in which nonetheless a molybdenum dithiocarbamate and an ashless friction modifier are jointly used, not only friction can be reduced early after commencement of lubrication, but also such a state can be maintained, is provided.

6 Claims, No Drawings

(56) References Cited

U.S. PATENT DOCUMENTS

| | | | |
|---|---|---|---|
| 2018/0355272 | A1 | 12/2018 | Onodera et al. |
| 2020/0181529 | A1 | 6/2020 | Suzuki et al. |

FOREIGN PATENT DOCUMENTS

| | | | |
|---|---|---|---|
| JP | 2011-184566 | | 9/2011 |
| JP | 2013-133453 | | 7/2013 |
| JP | 2013-199594 | | 10/2013 |
| JP | 2015-10177 | A | 1/2015 |
| JP | 2015-028186 | | 2/2015 |
| JP | 2015-140354 | A | 8/2015 |
| JP | 2017-105875 | | 6/2017 |
| JP | 2017-105886 | | 6/2017 |
| JP | 2017-179157 | A | 10/2017 |
| JP | 2018-021107 | | 2/2018 |
| JP | 2018-76411 | A | 5/2018 |
| WO | WO 96/19551 | | 6/1996 |
| WO | WO 2007/093632 | | 8/2007 |
| WO | WO 2015/111746 | | 7/2015 |
| WO | WO 2016/159185 | A1 | 10/2016 |
| WO | WO 2016/159258 | | 10/2016 |
| WO | WO 2017/099052 | | 6/2017 |
| WO | WO 2017/099140 | | 6/2017 |
| WO | WO 2018/033785 | | 2/2018 |

OTHER PUBLICATIONS

Office Action dated Aug. 3, 2020, in U.S. Appl. No. 16/320,811.
Japanese Office Action dated Jan. 5, 2021 in Japanese Patent Application No. 2019-067657 (with unedited computer generated English translation), 5 pages.

* cited by examiner

LUBRICATING OIL COMPOSITION

FIELD OF THE INVENTION

The present invention relates to a lubricating oil composition.

BACKGROUND OF THE INVENTION

In recent years, as environmental regulations are tightened, high fuel consumption is required for lubricating oil compositions to be used for internal combustion engines of vehicles, such as automobiles. As one of methods fulfilling such a requirement, there are investigated a variety of methods for reducing fiction by blending a friction modifier in a lubricating oil composition.

For example, there is known a method in which a molybdenum dithiocarbamate is blended as a friction modifier in a lubricating oil composition, thereby reducing the friction (see, for example, PTL 1).

In addition, there is also known a method in which at least one ashless friction modifier selected from an ester-based ashless friction modifier and an amine-based ashless friction modifier is blended in a lubricating oil composition, thereby reducing the friction (see, for example, PTL 2).

Here, it is known that the molybdenum dithiocarbamate exhibits a friction reducing effect in a region of a relatively high temperature. Meanwhile, it is known that the ashless friction modifier exhibits a friction reducing effect in a region of a relatively low temperature. In consequence, it can be expected that the friction reducing effect is exhibited in a wide-range temperature region through combined use of the molybdenum dithiocarbamate and the ashless friction modifier.

CITATION LIST

Patent Literature

PTL 1: JP 2015-010177 A
PTL 2: WO 2011/062282 A

SUMMARY OF THE INVENTION

However, when the molybdenum dithiocarbamate and the ashless friction modifier are jointly used, the friction reducing effect of the molybdenum dithiocarbamate is hindered by the ashless friction modifier. For that reason, the joint use of the molybdenum dithiocarbamate and the ashless friction modifier involves such a problem that the fuel consumption required for lubricating oil compositions cannot be thoroughly secured.

Meanwhile, as mentioned above, the fact that it can be expected that the friction reducing effect is exhibited in a wide-range temperature region through combined use of the molybdenum dithiocarbamate and the ashless friction modifier is attractive. Then, it may be considered that it is desirable to provide a lubricating oil composition in which nonetheless the molybdenum dithiocarbamate and the ashless friction modifier are jointly used, the friction reducing effect to be brought due to the molybdenum dithiocarbamate is not hindered by the ashless friction modifier.

Now, a requirement for fuel consumption against lubricating oil compositions to be used for internal combustion engines of vehicles, such as automobiles, is recently much more increasing. As one of methods fulfilling such a requirement, it may be considered to provide a lubricating oil composition which is able to not only reduce the friction early after commencement of lubrication but also maintain such a state. However, in view of an increase in the requirement for fuel consumption, viscosity reduction of a lubricating oil composition is advanced recently, and therefore, boundary lubrication becomes dominant, and there is the situation where the oil temperature is liable to increase. For that reason, when the friction reducing effect of a molybdenum dithiocarbamate is hindered by the ashless friction modifier, the friction reducing effect in a high-temperature region is hindered, so that it becomes extremely difficult to secure the fuel consumption required for lubricating oil compositions.

Then, an object of the present invention is to provide a viscosity-reduced lubricating oil composition in which nonetheless a molybdenum dithiocarbamate and an ashless friction modifier are jointly used, not only friction can be reduced early after commencement of lubrication without hindering a friction reducing effect of the molybdenum dithiocarbamate, but also such a state can be maintained.

In order to solve the aforementioned problem, the present inventors made extensive and intensive investigations. As a result, it has been found that the aforementioned problem can be solved by a lubricating oil composition containing a base oil (A), a molybdenum dithiocarbamate (B), an ester-based ashless friction modifier (C), and a metal salicylate (D), in which the content of a molybdenum atom derived from the molybdenum dithiocarbamate (B) is regulated to a specified range; a content ratio of the ester-based friction modifier (C) to the molybdenum atom derived from the molybdenum dithiocarbamate (B) is regulated to a specified range; and the content of a salicylate soap group derived from the metal salicylate (D) is regulated to a specified range.

Specifically, the present invention relates to the following [1] to [8].

[1] A lubricating oil composition containing
a base oil (A),
a molybdenum dithiocarbamate (B),
an ester-based ashless friction modifier (C), and
a metal salicylate (D), wherein
the content of a molybdenum atom derived from the molybdenum dithiocarbamate (B) is 650 ppm by mass or more on the basis of the whole amount of the lubricating oil composition;
a content ratio [$C/B_{Mo}$] of the ester-based ashless friction modifier (C) to a molybdenum atom derived from the molybdenum dithiocarbamate (B) is 5.0 to 10 in terms of a mass ratio;
the content of a salicylate soap group derived from the metal salicylate (D) is 0.50% by mass or more on the basis of the whole amount of the lubricating oil composition; and
a kinematic viscosity at 100° C. is 4.0 $mm^2/s$ or more and less than 9.3 $mm^2/s$, and a high-temperature high-shear viscosity at 150° C. is 1.7 mPa·s or more and less than 2.9 mPa·s.

[2] The lubricating oil composition as set forth in the above [1], wherein the metal salicylate (D) contains calcium salicylate (D1) and magnesium salicylate (D2).

[3] The lubricating oil composition as set forth in the above [1] or [2], wherein the content of the salicylate soap group derived from the metal salicylate (D) is 1.2% by mass or less on the basis of the whole amount of the lubricating oil composition.

[4] The lubricating oil composition as set forth in the above [2], wherein the content of a calcium atom derived from the calcium salicylate (D1) is 1,200 to 1,400 ppm by mass on the basis of the whole amount of the lubricating oil composition.

[5] The lubricating oil composition as set forth in the above [2] or [4], wherein the content of a magnesium atom derived from the magnesium salicylate (D2) is 600 to 800 ppm by mass on the basis of the whole amount of the lubricating oil composition.

[6] The lubricating oil composition as set forth in any one of the above [1] to [5], wherein a NOACK value is 15.0% by mass or less.

[7] The lubricating oil composition as set forth in any one of the above [1] to [6], wherein the content of a resin component derived from a viscosity index improver is 2% by mass or less on the basis of the whole amount of the lubricating oil composition.

[8] A lubricating oil composition including the lubricating oil composition as set forth in any one of the above [1] to [7], the lubricating oil composition being used for internal combustion engines.

In accordance with the present invention, it is possible to provide a viscosity-reduced lubricating oil composition in which nonetheless a molybdenum dithiocarbamate and an ashless friction modifier are jointly used, not only friction can be reduced early after commencement of lubrication, but also such a state can be maintained.

DETAILED DESCRIPTION OF THE INVENTION

Embodiments for carrying out the present invention are hereunder described in detail.

In this specification, regarding a preferred numerical value range (for example, a range of content or the like), a lower limit and an upper limit that are expressed in stages can be combined each independently. For example, from an expression of "preferably 10 to 90, and more preferably 30 to 60", "the preferred lower limit (10)" and "the more preferred upper limit (60)" may be combined to be "10 to 60".

Similarly, in this specification, the numerical values of "or more", "or less", "less than", and "more than" relating to the expression of a numerical value range are numerical values that can be combined arbitrarily.

In addition, in the following description, the effect capable of reducing the friction early after commencement of lubrication is also referred to as "early friction reducing effect". In addition, the effect capable of maintaining the state where the friction is reduced due to the early friction reducing effect is also referred to as "friction reduction maintaining effect".

[Lubricating Oil Composition]

The lubricating oil composition of the present invention is a lubricating oil composition containing a base oil (A), a molybdenum dithiocarbamate (B), an ester-based ashless friction modifier (C), and a metal salicylate (D), wherein the content of a molybdenum atom derived from the molybdenum dithiocarbamate (B) is 650 ppm by mass or more on the basis of the whole amount of the lubricating oil composition;

a content ratio [$C/B_{Mo}$] of the ester-based ashless friction modifier (C) to a molybdenum atom derived from the molybdenum dithiocarbamate (B) is 5.0 to 10 in terms of a mass ratio;

the content of a salicylate soap group derived from the metal salicylate (D) is 0.50% by mass or more on the basis of the whole amount of the lubricating oil composition; and a kinematic viscosity at 100° C. is 4.0 $mm^2/s$ or more and less than 9.3 $mm^2/s$, and a high-temperature high-shear viscosity at 150° C. is 1.7 mPa·s or more and less than 2.9 mPa·s.

As a result of extensive and intensive investigations made by the present inventors, it has been found that by jointly using the molybdenum dithiocarbamate and the ester-based ashless friction modifier and further regulating the content of the salicylate soap group derived from the metal salicylate to a specified range, the ester-based ashless friction modifier does not hinder the friction reducing effect of the molybdenum dithiocarbamate, and on the contrary, there is rather brought an extremely excellent effect such that not only the friction can be reduced early after commencement of lubrication, but also such a state can be maintained.

In this specification, in the following description, the "base oil (A)", the "molybdenum dithiocarbamate (B)", the "ester-based ashless friction modifier (C)", and the "metal salicylate (D)" are also referred to as "component (A)", "component (B)", "component (C)", and "component (D)", respectively.

Although the lubricating oil composition according to one embodiment of the present invention may be composed of only the component (A), the component (B), the component (C), and the component (D), it may contain other additive for lubricating oil than the component (A), the component (B), the component (C), and the component (D) within a range where the effects of the present invention are not impaired.

In the lubricating oil composition according to one embodiment of the present invention, the total content of the component (A), the component (B), the component (C), and the component (D) is preferably 70% by mass or more, more preferably 80% by mass or more, and still more preferably 90% by mass or more on the basis of the whole amount of the lubricating oil composition.

In the lubricating oil composition according to one embodiment of the present invention, an upper limit value of the total content of the component (A), the component (B), the component (C), and the component (D) may be regulated in relation to the content of the other additive for lubricating oil than the component (A), the component (B), the component (C), and the component (D), and it is preferably 97% by mass or less, more preferably 95% by mass or less, and still more preferably 93% by mass or less.

Each of the components which are contained in the lubricating oil composition of the present invention is hereunder described in detail.

<Base Oil (A)>

The lubricating oil composition of the present invention contains the base oil (A).

As the base oil (A) which the lubricating oil composition of the present invention contains, at least one selected from mineral oils and synthetic oils which have been conventionally used as a base oil of lubricating oil can be used without being particularly limited.

Examples of the mineral oil include a topped crude obtained by atmospheric distillation of a crude oil, such as a paraffinic crude oil, an intermediate crude oil, and a naphthenic crude oil; a distillate oil obtained by vacuum distillation of the topped crude; and a mineral oil obtained by subjecting the distillate oil to at least one purification process, such as solvent deasphalting, solvent extraction, hydrocracking, solvent dewaxing, catalytic dewaxing, and hydrofinishing.

Examples of the synthetic oil include a poly-α-olefin, such as an α-olefin homopolymer and an α-olefin copolymer (for example, an α-olefin copolymer having 8 to 14 carbon atoms, such as an ethylene-α-olefin copolymer); an isoparaffin; an ester of every kind, such as a polyol ester and a dibasic acid ester; an ether of every kind, such as a polyphenyl ether; a polyalkylene glycol; an alkylbenzene; an alkylnaphthalene; and a GTL base oil obtained by isomerizing a wax produced from a natural gas by the Fischer-Tropsch method or the like (gas-to-liquid (GTL) wax).

The base oil (A) which is used in one embodiment of the present invention is preferably a base oil classified into Group 2, 3, or 4 in the base oil category by the American Petroleum Institute (API), and more preferably a base oil classified into Group 2 or 3.

As for the base oil (A), a mineral oil may be used alone or in combination of plural kinds thereof, and a synthetic oil may be used alone or in combination of plural kinds thereof. In addition, at least one mineral oil and at least one synthetic oil may be combined and used.

A kinematic viscosity at 100° C. (hereinafter also referred to as "100° C. kinematic viscosity") of the base oil (A) is preferably 2 to 10 $mm^2/s$, more preferably 2 to 6 $mm^2/s$, and still more preferably 3 to 5 $mm^2/s$.

When the 100° C. kinematic viscosity of the base oil (A) is 2 $mm^2/s$ or more, an evaporation loss is readily suppressed.

When the 100° C. kinematic viscosity of the base oil (A) is 10 $mm^2/s$ or less, a power loss to be caused due to viscous resistance is readily suppressed, and a fuel consumption improving effect is readily obtained.

From the viewpoint of not only suppressing a viscosity change to be caused due to a temperature change but also improving the fuel consumption, a viscosity index of the base oil (A) is preferably 100 or more, more preferably 110 or more, still more preferably 120 or more, and yet still more preferably 130 or more.

In this specification, the 100° C. kinematic viscosity and the viscosity index mean values as measured or calculated in conformity with JIS K2283:2000.

In one embodiment of the present invention, in the case where the base oil (A) is a mixed base oil containing two or more kinds of base oils, it is preferred that the kinematic viscosity and the viscosity index of the mixed base oil fall within the aforementioned ranges, respectively.

In the lubricating oil composition according to one embodiment of the present invention, the content of the base oil (A) is preferably 90% by mass or less on the basis of the whole amount of the lubricating oil composition (100% by mass). When the content of the base oil (A) is regulated to 90% by mass or less, the use amounts of the molybdenum dithiocarbamate (B), the ester-based ashless friction modifier (C), and the metal salicylate (D) can be thoroughly secured, and the early friction reducing effect and the friction reduction maintaining effect can be more readily exhibited.

From the viewpoint of making the effects of the present invention exhibit more readily, the content of the base oil (A) is preferably 75 to 90% by mass, more preferably 80 to 90% by mass, and still more preferably 85 to 90% by mass on the basis of the whole content of the lubricating oil composition.

<Molybdenum Dithiocarbamate (B)>

The lubricating oil composition of the present invention contains the molybdenum dithiocarbamate (B).

Examples of the molybdenum dithiocarbamate include a binuclear molybdenum dithiocarbamate having two molybdenum atoms in one molecule thereof and a trinuclear molybdenum dithiocarbamate having three molybdenum atoms in one molecule thereof.

In the present invention, the molybdenum dithiocarbamate may be used alone or in combination of two or more thereof.

The binuclear molybdenum dithiocarbamate is preferably a compound represented by the following general formula (B1-1) or a compound represented by the following general formula (B1-2).

(B1-1)

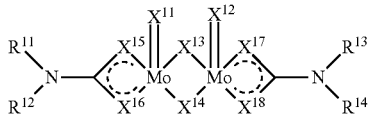

(B1-2)

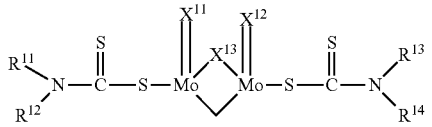

In the formulae (B1-1) and (B1-2), $R^{11}$ to $R^{14}$ each independently represent a hydrocarbon group, and these may be the same as or different from each other.

$X^{11}$ to $X^{18}$ each independently represent an oxygen atom or a sulfur atom, and they may be the same as or different from each other. However, at least two of $X^{11}$ to $X^{18}$ in the formula (B1-1) are sulfur atoms.

In one embodiment of the present invention, in the formula (B1-1), it is preferred that $X^{11}$ and $X^{12}$ are oxygen atoms, and $X^{13}$ to $X^{18}$ are sulfur atoms.

In the general formula (B1-1), from the viewpoint of improving solubility in the base oil (A), a molar ratio of the sulfur atom to the oxygen atom [(sulfur atom)/(oxygen atom)] in $X^{11}$ to $X^{18}$ is preferably ¼ to 4/1, and more preferably ⅓ to 3/1.

In the formula (B1-2), $X^{11}$ to $X^{14}$ are preferably oxygen atoms.

The carbon number of the hydrocarbon group which can be selected as $R^{11}$ to $R^{14}$ is preferably 6 to 22, more preferably 7 to 18, still more preferably 7 to 14, and yet still more preferably 8 to 13.

Examples of the hydrocarbon group which can be selected as $R^{11}$ to $R^{14}$ in the general formulae (B1-1) and (B1-2) include an alkyl group, an alkenyl group, a cycloalkyl group, an aryl group, an alkylaryl group, and an arylalkyl group, with an alkyl group being preferred.

Examples of the alkyl group include a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, and an octadecyl group.

Examples of the alkenyl group include a hexenyl group, a heptenyl group, an octenyl group, a nonenyl group, a decenyl group, an undecenyl group, a dodecenyl group, tridecenyl group, a tetradecenyl group, and a pentadecenyl group.

Examples of the cycloalkyl group include a cyclohexyl group, a dimethylcyclohexyl group, an ethylcyclohexyl group, a methylcyclohexylmethyl group, a cyclohexylethyl group, a propylcyclohexyl group, a butylcyclohexyl group, and a heptylcyclohexyl group.

Examples of the aryl group include a phenyl group, a naphthyl group, an anthracenyl group, a biphenyl group, and a terphenyl group.

Examples of the alkylaryl group include a tolyl group, a dimethylphenyl group, a butylphenyl group, a nonylphenyl group, and a dimethylnaphthyl group.

Examples of the arylalkyl group include a methylbenzyl group, a phenylmethyl group, a phenylethyl group, and a diphenylmethyl group.

The trinuclear molybdenum dithiocarbamate is preferably a compound represented by the following general formula (B1-3).

$$Mo_3S_kE_mL_nA_pQ_z \quad \text{(B1-3)}$$

In the general formula (B1-3), k is an inter of 1 or more; m is an integer of 0 or more; (k+m) is an integer of 4 to 10, and preferably an integer of 4 to 7; n is an integer of 1 to 4; p is an integer of 0 or more; and z is an integer of 0 to 5, inclusive of a nonstoichiometric value.

E's are each independently an oxygen atom or a selenium atom, and for example, one capable of substituting sulfur in a core as mentioned later.

L's are each independently an anionic ligand having a carbon atom-containing organic group; the sum total of carbon atoms of the organic group in each of the ligands is 14 or more; and the respective ligands may be the same as or different from each other.

A's are each independently an anion other than L.

Q's are each independently a compound capable of providing a neutral electron and exist for filling a blank coordination on the trinuclear molybdenum compound.

In the lubricating oil composition of the present invention, the content of the molybdenum atom derived from the molybdenum dithiocarbamate (MoDTC) is 650 ppm by mass or more on the basis of the whole amount of the lubricating oil composition.

When the content of the molybdenum atom derived from the molybdenum dithiocarbamate (MoDTC) is less than 650 ppm by mass, the early friction reducing effect is not obtained.

Here, in one embodiment of the present invention, from the viewpoint of making it easy to more improve the effects of the present invention, the content of the molybdenum atom derived from the molybdenum dithiocarbamate (MoDTC) is preferably 650 to 800 ppm by mass, more preferably 670 to 750 ppm by mass, and still more preferably 680 to 720 ppm by mass.

In one embodiment of the present invention, it is preferred to regulate the content of the molybdenum dithiocarbamate (MoDTC) such that the content of the molybdenum atom derived from the molybdenum dithiocarbamate (MoDTC) falls within the aforementioned range. Specifically, the content of the molybdenum dithiocarbamate (MoDTC) is preferably 0.65 to 0.80% by mass, more preferably 0.67 to 0.75% by mass, and still more preferably 0.68 to 0.72% by mass on the basis of the whole amount of the lubricating oil composition.

<Ester-Based Ashless Friction Modifier (C)>

The lubricating oil composition of the present invention contains the ester-based ashless friction modifier (C).

Although various ester compounds can be used as the ester-based ashless friction modifier (C), for example, the ester-based ashless friction modifier (C) is preferably at least one selected from an alkyl ester represented by the following general formula (C-0) and its derivative.

(C-0)

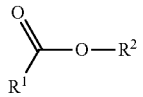

In the general formula (C-0), $R^1$ is a hydrocarbon group having 1 to 32 carbon atoms. The carbon number of the hydrocarbon group as $R^1$ is preferably 8 to 32, more preferably 12 to 24, and still more preferably 16 to 20.

The hydrocarbon group as $R^1$ may be either saturated or unsaturated, may be either aliphatic or aromatic, and may be any of linear, branched, or cyclic.

In the general formula (C-0), $R^2$ is a hydrocarbon group having 1 to 50 carbon atoms. The carbon number of the hydrocarbon group as $R^2$ is preferably 2 to 32, more preferably 2 to 20, and still more preferably 2 to 10.

The hydrocarbon group as $R^2$ is a saturated or unsaturated aliphatic hydrocarbon group, and the aliphatic hydrocarbon group may be any of linear, branched, or cyclic. In addition, the hydrocarbon group as $R^2$ may be substituted with one or more substituents. Examples of the substituent include a hydroxy group. The hydrocarbon group as $R^2$ is preferably a linear saturated aliphatic hydrocarbon group, and more preferably a linear saturated aliphatic hydrocarbon group substituted with one or more hydroxy groups.

In this specification, in the general formula (C-0), one in which $R^2$ is a linear saturated aliphatic hydrocarbon group, and the linear saturated aliphatic hydrocarbon group is not substituted with a substituent is referred to as "alkyl ester", whereas one in which the linear saturated aliphatic hydrocarbon group is substituted with a substituent is referred to as "alkyl ester derivative". Examples of the substituent include at least one selected from a hydroxy group and —O—C(O)—R (R is a hydrocarbon group, and preferably a hydrocarbon group having 1 to 32 carbon atoms).

Here, as the alkyl ester and its derivative, an ester compound having at least one hydroxy group in a molecule thereof is preferred, and an ester compound having two or more hydroxy groups in a molecule thereof is more preferred.

From the viewpoint of making it easy to improve the effects of the present invention, the carbon number of the ester compound having at least one hydroxy group in a molecule thereof is preferably 2 to 24, more preferably 10 to 24, and still more preferably 16 to 24.

Examples of the ester compound having at least one hydroxy group in a molecule thereof include an ester compound having one hydroxy group in a molecule thereof as represented by the following general formula (C-1); and an ester compound having two hydroxy groups in a molecule thereof as represented by the following general formula (C-2).

Of these, the compound represented by the following general (C-2) is preferred.

(C-1)

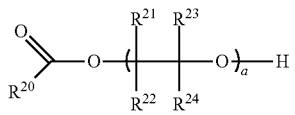

(C-2)

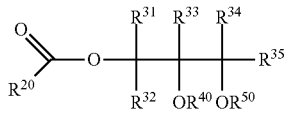

-continued (C-2-1)

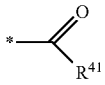

(C-2-2)

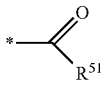

In the general formulae (C-1) and (C-2), $R^{20}$ and $R^{30}$ are each a hydrocarbon group having 1 to 32 carbon atoms. In addition, in the general formulae (C-2-1) and (C-2-2), $R^{41}$ and $R^{51}$ are each a hydrocarbon group having 1 to 32 carbon atoms.

In the general formula (C-2), $R^{40}$ is a hydrogen atom or a monovalent group represented by the general formula (C-2-1). In addition, in the general formula (C-2), $R^{50}$ is a hydrogen atom or a monovalent group represented by the general formula (C-2-2). In the general formulae (C-2-1) and (C-2-2), "*" means a binding position to the oxygen atom of $OR^{40}$ in the general formula (C-2) and a binding position to the oxygen atom of $OR^{50}$ in the general formula (C-2), respectively.

In the compound represented by the general formula (C-2), either one or both of $R^{40}$ and $R^{50}$ are a hydrogen atom. In consequence, among the compounds represented by the general formula (C-2), compounds in which not only $R^{40}$ is a monovalent group represented by the general formula (C-2-1), but also $R^{50}$ is a monovalent group represented by the general formula (C-2-2) are excluded. Namely, compounds not having a hydroxy group are excluded.

Here, in the compound represented by the general formula (C-2), both of $R^{40}$ and $R^{50}$ are a hydrogen atom are preferred. That is, the compound represented by the general formula (C-2) is preferably a compound having two hydroxy groups in a molecule thereof.

In addition, the carbon number of each of the hydrocarbon groups as $R^{20}$, $R^{30}$, $R^{41}$, and $R^{51}$ is preferably 8 to 32, more preferably 12 to 24, and still more preferably 16 to 20.

Examples of each of the hydrocarbon groups as $R^{20}$, $R^{30}$, $R^{41}$, and $R^{51}$ include an alkyl group, an alkenyl group, an alkylaryl group, a cycloalkyl group, and a cycloalkenyl group. Of these, an alkyl group or an alkenyl group is preferred, and above all, an alkenyl group is preferred.

Examples of the alkyl group as each of $R^{20}$, $R^{30}$, $R^{41}$, and $R^{51}$ include a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosyl group, a heneicosyl group, a docosyl group, a tricosyl group, and a tetracosyl group. These may be any of linear, branched, or cyclic.

Examples of the alkenyl group as each of $R^{20}$, $R^{30}$, $R^{41}$, and $R^{51}$ include a vinyl group, a propenyl group, a butenyl group, a pentenyl group, a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, an eicosenyl group, a heneicosenyl group, a docosenyl group, a tricosenyl group, and a tetracosenyl group. These may be any of linear, branched, or cyclic, and a position of the double bond is arbitrary.

$R^{21}$ to $R^{24}$, and $R^{31}$ to $R^{35}$ are each a hydrogen atom or a hydrocarbon group having 1 to 18 carbon atoms, and they may be the same as or different from each other.

In the general formula (C-1), it is preferred that all of $R^{21}$ to $R^{24}$ are a hydrogen atom; or not only all of $R^{21}$ to $R^{23}$ are a hydrogen atom, but also $R^{24}$ is a hydrocarbon group. In addition, in the general formula (C-2), it is preferred that all of $R^{31}$ to $R^{35}$ are a hydrogen atom.

In the case where the compound represented by the general formula (C-1) is used as the ester-based ashless friction modifier (C), a single kind in which all of $R^{20}$ to $R^{24}$ are identical may be used, and a mixture of two or more kinds in which a part of $R^{20}$ to $R^{24}$ is different (for example, the carbon number of $R^{20}$ or the presence or absence of a double bond is different) may also be used.

Similarly, in the case where the compound represented by the general formula (C-2) is used as the ester-based ashless friction modifier (C), a single kind in which all of $R^{30}$ to $R^{35}$, $R^{40}$, and $R^{50}$ are identical may be used, and a mixture of two or more kinds in which a part of $R^{30}$ to $R^{35}$, $R^{40}$, and $R^{50}$ is different (for example, the carbon number of $R^{30}$, $R^{41}$, and $R^{51}$ or the presence or absence of a double bond is different, or $R^{31}$ to $R^{35}$ are different) may also be used.

In the case where $R^{21}$ to $R^{24}$, and $R^{31}$ to $R^{35}$ are each a hydrocarbon group, the hydrocarbon group may be either saturated or unsaturated, may be either aliphatic or aromatic, and may be any of linear, branched, or cyclic.

Although a in the general formula (C-1) represents an integer of 1 to 20, it is preferably 1 to 12, and more preferably 1 to 10.

The compound represented by the general formula (C-1) is, for example, one obtained through a reaction between a fatty acid and an alkylene oxide.

Here, examples of the fatty acid for obtaining the compound represented by the general formula (C-1) include lauric acid, myristic acid, palmitic acid, oleic acid, tallow fatty acid, and coconut oil fatty acid. In addition, examples of the alkylene oxide include an alkylene oxide having 2 to 12 carbon atoms. Specifically, examples thereof include ethylene oxide, propylene oxide, butylene oxide, hexylene oxide, octylene oxide, decylene oxide, and dodecylene oxide.

Examples of the compound represented by the general formula (C-1) include polyoxyethylene monolaurate, polyoxyethylene monostearate, and polyoxyethylene monooleate.

Examples of the compound represented by the general formula (C-2) include fatty acid glycerides, such as a lauric acid glyceride, an oleic acid glyceride, and a stearic acid glyceride. More specifically, examples thereof include a glycerin fatty acid monoester, such as glycerin monolaurate, glycerin monostearate, and glycerin monooleate; and a glycerin fatty acid diester, such as glycerin dilaurate, glycerin distearate, and glycerin dioleate. Of these, a glycerin fatty acid monoester is preferred, and glycerin monooleate is more preferred.

These may be used alone or may be used in combination of two or more thereof. For example, a glycerin fatty acid monoester and a glycerin fatty acid diester may be combined and used.

In the lubricating oil composition of the present invention, a content ratio $[C/B_{Mo}]$ of the ester-based ashless friction modifier (C) to a molybdenum atom derived from the molybdenum dithiocarbamate (B) is 5.0 to 10 in terms of a mass ratio.

When the content ratio [$C/B_{Mo}$] is less than 5.0, the friction reducing effect in a low-temperature region, which can be brought by the ester-based ashless friction modifier (C), is hardly obtained.

When the content ratio [$C/B_{Mo}$] is more than 10, the friction reducing effect of the molybdenum dithiocarbamate (B) is liable to be hindered by the ashless friction modifier (C), and the effects of the present invention are hardly exhibited.

Here, in one embodiment of the present invention, from the viewpoint of making it easy to more improve the effects of the present invention while thoroughly maintaining the friction reducing effect in a low-temperature region at 100° C. or lower, the content ratio [$C/B_{Mo}$] is preferably 5.0 to 9.0, more preferably 6.0 to 8.0, and still more preferably 7.0 to 8.0.

In one embodiment of the present invention, it is preferred that the content of the ester-based ashless friction modifier (C) is regulated such that the content ratio [$C/B_{Mo}$] falls within the aforementioned range. Specifically, the content of the ester-based ashless friction modifier (C) is preferably 0.30 to 0.70% by mass, more preferably 0.35 to 0.65% by mass, and still more preferably 0.40 to 0.60% by mass on the basis of the whole amount of the lubricating oil composition.

<Metal Salicylate (D)>

The lubricating oil composition of the present invention contains the metal salicylate (D).

As the metal atom which is contained in the metal salicylate, an alkali metal, such as sodium and potassium, and an alkaline earth metal, such as magnesium, calcium, and barium, are preferred; an alkaline earth metal, such as magnesium, calcium, and barium, is more preferred; and magnesium and calcium are still more preferred.

In one embodiment of the present invention, though the metal salicylate (D) may be used alone or may be used in combination of two or more thereof, it is preferred to use a combination of two or more thereof, and it is more preferred to use a combination of calcium salicylate (D1) and magnesium salicylate (D2).

In one embodiment of the present invention, from the viewpoint of making it easy to more improve the effects of the present invention, the metal salicylate (D) has a base number of preferably 200 to 500 mgKOH/g, more preferably 250 to 400 mgKOH/g, and still more preferably 300 to 350 mgKOH/g.

In this specification, the base number is a total base number as measured by the perchloric acid method described in JIS K2501:2003.

In the lubricating oil composition of the present invention, the content of a salicylate soap group derived from the metal salicylate (D) is 0.50% by mass or more on the basis of the whole amount of the lubricating oil composition.

When the content of the salicylate soap group derived from the metal salicylate (D) is less than 0.50% by mass on the basis of the whole amount of the lubricating oil composition, the early friction reducing effect is not obtained.

In this specification, the "salicylate soap group derived from the metal salicylate (D)" means an alkyl salicylic acid group constituting the metal salicylate (D). The content of the salicylate soap group derived from the metal salicylate (D) can be obtained by subjecting the metal salicylate (D) to rubber membrane dialysis, treating the rubber membrane residue after dialysis with hydrochloric acid, and then quantitatively determining a component extracted with diethyl ether as a soap component.

The carbon number of the alkyl group which the alkyl salicylic acid group that is the soap group has is preferably 4 to 30, more preferably 6 to 24, and still more preferably 10 to 24. The alkyl group may be either linear or branched. In addition, in the case where the metal salicylate (D) has plural alkyl groups in the same molecule, these alkyl groups may be the same as or different from each other.

In one embodiment of the present invention, from the viewpoint of not only making it easy to obtain the friction reduction maintaining effect but also making it easy to obtain the early friction reducing effect, the content of the salicylate soap group derived from the metal salicylate (D) is preferably 0.50 to 1.20% by mass, more preferably 0.55 to 1.00% by mass, and still more preferably 0.55 to 0.80% by mass on the basis of the whole amount of the lubricating oil composition.

In one embodiment of the present invention, it is preferred to regulate the content of the metal salicylate (D) such that the content of the salicylate soap group derived from the metal salicylate (D) falls within the aforementioned range. Specifically, the content of the metal salicylate (D) is preferably 1.10 to 3.00% by mass, more preferably 1.30 to 2.80% by mass, and still more preferably 1.50 to 2.70% by mass on the basis of the whole amount of the lubricating oil composition.

Here, in one embodiment of the present invention, from the viewpoint of making it easy to more improve the effects of the present invention, it is preferred that the metal salicylate (D) contains calcium salicylate (D1) and magnesium salicylate (D2).

In one embodiment of the present invention, from the viewpoint of making it easy to still more improve the effects of the present invention, in the case where the metal salicylate (D) contains calcium salicylate (D1) and magnesium salicylate (D2), the content of the calcium atom derived from the calcium salicylate (D1) is preferably 1,200 to 1,400 ppm by mass, more preferably 1,240 to 1,360 ppm by mass, and still more preferably 1,280 to 1,320 ppm by mass on the basis of the whole amount of the lubricating oil composition.

Furthermore, in one embodiment of the present invention, from the viewpoint of making it easy to still more improve the effects of the present invention, in the case where the metal salicylate (D) contains calcium salicylate (D1) and magnesium salicylate (D2), the content of the magnesium atom derived from the magnesium salicylate (D2) is preferably 600 to 800 ppm by mass, more preferably 640 to 760 ppm by mass, and still more preferably 680 to 720 ppm by mass on the basis of the whole amount of the lubricating oil composition.

<Other Additive for Lubricating Oil>

The lubricating oil composition according to one embodiment of the present invention may contain other additive for lubricating oil, which does not correspond to the component (B), the component (C), and the component (D) within a range where the effects of the present invention are not impaired.

Examples of the other additive for lubricating oil include other metal-based friction modifier than the component (B); other ashless friction modifier than the component (C); and other agent than the component (D), such as a metallic detergent, a viscosity index improver, an anti-wear agent, an extreme pressure agent, an antioxidant, an ashless dispersant, a pour-point depressant, a rust inhibitor, an anti-foaming agent, a metal deactivator, and a demulsifier.

These respective additives for lubricating oil may be used alone or may be used in combination of two or more thereof.

Although the content of each of these additives for lubricating oil can be appropriately regulated within a range where the effects of the present invention are not impaired, it is independently typically 0.001 to 15% by mass, preferably 0.005 to 10% by mass, more preferably 0.01 to 8% by mass, and still more preferably 0.1 to 6% by mass on the basis of the whole amount (100% by mass) of the lubricating oil composition.

(Other Metal-Based Friction Modifier than Component (B))

The lubricating oil composition according to one embodiment of the present invention may contain other metal-based friction modifier than the component (B) within a range where the effects of the present invention are not impaired.

Examples of the other metal-based friction modifier than the component (B) include at least one selected from organic molybdenum-based compounds, such as molybdenum dithiophosphate (MoDTP) and an amine salt of molybdic acid.

(Other Ashless Friction Modifier than Component (C))

The lubricating oil composition according to one embodiment of the present invention may contain other ashless friction modifier than the component (C) within a range where the effects of the present invention are not impaired.

Examples of the other ashless friction modifier than the component (C) include at least one selected from an amine-based ashless friction modifier and an ether-based ashless friction modifier.

Here, in one embodiment of the present invention, from the viewpoint of making it easy to more improve the effects of the present invention, it is preferred that the content of the at least one ashless friction modifier selected from an amine-based ashless friction modifier and an ether-based ashless friction modifier is low. Specifically, the content of the foregoing ashless friction modifier is preferably less than 0.50% by mass, more preferably less than 0.10% by mass, and still more preferably less than 0.01% by mass on the basis of the whole amount of the lubricating oil composition. It is more preferred that the lubricating oil composition according to one embodiment of the present invention does not contain the at least one ashless friction modifier selected from an amine-based ashless friction modifier and an ether-based ashless friction modifier.

(Other Metallic Detergent than Component (D))

The lubricating oil composition according to one embodiment of the present invention may contain other metallic detergent than the component (D) within a range where the effects of the present invention are not impaired.

Examples of the other metallic detergent than the component (D) include a metal sulfonate.

As the metal atom which is contained in the metal sulfonate, an alkali metal, such as sodium and potassium, and an alkaline earth metal, such as magnesium, calcium, and barium, are preferred; an alkaline earth metal, such as magnesium, calcium, and barium, is more preferred; and magnesium is still more preferred.

In the case where the lubricating oil composition according to one embodiment of the present invention contains the other metallic detergent than the component (D), the content of the metallic detergent is preferably 0.50 to 1.00% by mass, more preferably 0.60 to 0.90% by mass, and still more preferably 0.65 to 0.85% by mass on the basis of the whole amount of the lubricating oil composition.

In the case where the lubricating oil composition according to one embodiment of the present invention contains magnesium sulfonate as the other metallic detergent than the component (D), the content of the magnesium atom derived from the magnesium sulfonate is preferably 600 to 800 ppm by mass, more preferably 640 to 760 ppm by mass, and still more preferably 680 to 720 ppm by mass on the basis of the whole amount of the lubricating oil composition.

In the case where the lubricating oil composition according to one embodiment of the present invention not only contains the magnesium salicylate (D2) as the component (D) but also contains magnesium sulfonate, it is preferred that the total content of the magnesium atom of the magnesium salicylate (D2) and the magnesium sulfonate is regulated to the aforementioned range.

(Viscosity Index Improver)

Examples of the viscosity index improver include polymers, such as a non-dispersant-type polymethacrylate, a dispersant-type polymethacrylate, an olefin-based copolymer (for example, an ethylene-propylene copolymer), a dispersant-type olefin-based copolymer, and a styrene-based copolymer (for example, a styrene-diene copolymer and a styrene-isoprene copolymer).

These may be used alone or may be used in combination of two or more thereof.

Although a mass average molecular weight (Mw) of such a viscosity index improver is typically 500 to 1,000,000, preferably 5,000 to 100,000, and more preferably 10,000 to 50,000, it is appropriately set according to the kind of the polymer.

In this specification, the mass average molecular weight (Mw) of each of the components is a value expressed in terms of standard polystyrene as measured by the gel permeation chromatography (GPC).

In the lubricating oil composition according to one embodiment of the present invention, from the viewpoint of regulating the HTHS viscosity at 150° C. to a range of 1.7 mPa·s or more and less than 2.9 mPa·s, the content of the resin component derived from the viscosity index improver is preferably 2% by mass or less, more preferably 1% by mass or less, still more preferably 0.5% by mass or less, and yet still more preferably 0.2% by mass or less on the basis of the whole amount of the lubricating oil composition. It is yet still more preferred that the lubricating oil composition according to one embodiment of the present invention does not contain the viscosity index improver.

(Anti-Wear Agent or Extreme Pressure Agent)

Examples of the anti-wear agent or the extreme pressure agent include a zinc dialkyldithiophosphate (ZnDTP), zinc phosphate, zinc dithiocarbamate; sulfur-containing compounds, such as a disulfide, a sulfurized olefin, a sulfurized oil and fat, a sulfurized ester, a thiocarbonate, a thiocarbamate, and a polysulfide; phosphorus-containing compounds, such as a phosphorous acid ester, a phosphoric acid ester, a phosphonic acid ester, and an amine salt or metal salt thereof; and sulfur and phosphorus-containing anti-wear agents, such as a thiophosphorous acid ester, a thiophosphoric acid ester, a thiophosphonic acid ester, and an amine salt or metal salt thereof.

Of these, a zinc dialkyldithiophosphate (ZnDTP) is preferred.

(Antioxidant)

Examples of the antioxidant include an amine-based antioxidant, a phenol-based antioxidant, a molybdenum-based antioxidant, a sulfur-based antioxidant, and a phosphorus-based antioxidant. These may be used alone or may be used in combination of two or more thereof.

Of these, an amine-based antioxidant and a phenol-based antioxidant are preferred, and combined use of an amine-based antioxidant and a phenol-based antioxidant is more preferred.

Examples of the amine-based antioxidant include diphenylamine-based antioxidants, such as diphenylamine and an alkylated diphenylamine having an alkyl group having 3 to 20 carbon atoms; and naphthylamine-based antioxidants, such as α-naphthylamine and a phenyl-α-naphthylamine substituted with an alkyl group having 3 to 20 carbon atoms.

Examples of the phenol-based antioxidant include monophenol-based antioxidants, such as 2,6-di-tert-butyl-4-methylphenol, 2,6-di-tert-butyl-4-ethylphenol, and octadecyl-3-(3,5-di-tert-butyl-4-hydroxyphenyl)propionate; diphenol-based antioxidants, such as 4,4'-methylenebis(2,6-di-tert-butylphenol) and 2,2'-methylenebis(4-ethyl-6-tert-butylphenol); and hindered phenol-based antioxidants.

(Ashless Dispersant)

Examples of the ashless dispersant include a boron-free succinimide, such as a boron-free alkenyl succinimide; a boron-containing succinimide, such as a boron-containing alkenyl succinimide; a benzylamine; a boron-containing benzylamine; a succinic acid ester; and a monovalent or divalent carboxylic acid amide, represented by a fatty acid or succinic acid. These may be used alone or may be used in combination of two or more thereof.

Of these, a boron-free alkenyl succinimide and a boron-containing alkenyl succinimide are preferred, and combined use of a boron-free alkenyl succinimide and a boron-containing alkenyl succinimide is more preferred.

(Pour-Point Depressant)

Examples of the pour-point depressant include an ethylene-vinyl acetate copolymer, a condensate of a chlorinated paraffin and naphthalene, a condensate of a chlorinated paraffin and phenol, a polymethacrylate, and a polyalkylstyrene. These may be used alone or may be used in combination of two or more thereof.

(Rust Inhibitor)

Examples of the rust inhibitor include a fatty acid, an alkenyl succinic acid half ester, a fatty acid soap, an alkylsulfonic acid salt, a polyhydric alcohol fatty acid ester, a fatty acid amine, an oxidized paraffin, and an alkyl polyoxyethylene ether. These may be used alone or may be used in combination of two or more thereof.

(Anti-Foaming Agent)

Examples of the anti-foaming agent include a silicone oil, a fluorosilicone oil, and a fluoroalkyl ether. These may be used alone or may be used in combination of two or more thereof.

(Metal Deactivator)

Examples of the metal deactivator include a benzotriazole-based compound, a tolyltriazole-based compound, a thiadiazole-based compound, an imidazole-based compound, and a pyrimidine-based compound. These may be used alone or may be used in combination of two or more thereof.

(Demulsifier)

Examples of the demulsifier include anionic surfactants, such as a sulfuric acid ester salt of castor oil and a petroleum sulfonic acid salt; cationic surfactants, such as a quaternary ammonium salt and an imidazoline; a polyoxyalkylene polyglycol and its ester of a dicarboxylic acid; and alkylene oxide adducts of an alkyl phenol-formaldehyde polycondensate. These may be used alone or may be used in combination of two or more thereof.

[Characteristics of Lubricating Oil Composition]

<Kinematic Viscosity>

In the lubricating oil composition of the present invention, its 100° C. kinematic viscosity is 4.0 $mm^2/s$ or more and less than 9.3 $mm^2/s$.

When the 100° C. kinematic viscosity of the lubricating oil composition of the present invention is less than 4.0 $mm^2/s$, it becomes hard to hold an oil film, whereas when it is 9.3 $mm^2/s$ or more, the fuel consumption is lowered.

From such a viewpoint, in the lubricating oil composition according to one embodiment of the present invention, the 100° C. kinematic viscosity is preferably 4.1 $mm^2/s$ or more and 8.2 $mm^2/s$ or less, more preferably 4.1 $mm^2/s$ or more and 6.9 $mm^2/s$ or less, and still more preferably 4.1 $mm^2/s$ or more and less than 6.9 $mm^2/s$.

<High-Temperature High-Shear Viscosity (HTHS Viscosity)>

In the lubricating oil composition of the present invention, its HTHS viscosity at 150° C. is 1.7 mPa·s or more and less than 2.9 mPa·s.

When the HTHS viscosity of the lubricating oil composition of the present invention is less than 1.7 mPa·s, it becomes hard to hold an oil film, whereas when it is 2.9 mPa·s or more, the fuel consumption is lowered.

From such a viewpoint, in the lubricating oil composition according to one embodiment of the present invention, the HTHS viscosity at 150° C. is preferably 1.7 mPa·s or more and 2.6 mPa·s or less, more preferably 1.7 mPa·s or more and 2.3 mPa·s or less, and still more preferably 1.7 mPa·s or more and less than 2.3 mPa·s.

<Coefficient of Friction at 100° C. in MTM Friction Test>

The lubricating oil composition of the present invention is excellent with respect to the early friction reducing effect and the friction reduction maintaining effect.

In the lubricating oil composition according to one embodiment of the present invention, in the MTM (mini traction machine) friction test as carried out by the method described in the section of Examples as mentioned later, its coefficient of friction at 100° C. 30 minutes after commencement of the test is preferably 0.050 or less, more preferably 0.045 or less, and still more preferably 0.043 or less.

In the lubricating oil composition according to one embodiment of the present invention, in the MTM friction test as carried out by the method described in the section of Examples as mentioned later, its coefficient of friction at 100° C. 240 minutes after commencement of the test is preferably 0.050 or less, more preferably 0.045 or less, and still more preferably 0.040 or less.

<NOACK Value>

In the lubricating oil composition according to one embodiment of the present invention, its NOACK value (at 250° C. for 1 hour) is preferably 15.0% by mass or less, more preferably 14.5% by mass or less, and still more preferably 14.2% by mass or less. In addition, the NOACK value is preferably 1.0% by mass or more, more preferably 3.0% by mass or more, and still more preferably 5.0% by mass or more.

When the NOACK value falls within the aforementioned range, the high-temperature oxidation stability is maintained favorable, and the generation of thickening of the lubricating oil composition is suppressed, thereby contributing to improvement of the fuel consumption.

[Application of Lubricating Oil Composition]

The lubricating oil composition according to one embodiment of the present invention can be preferably used as a lubricating oil composition of an internal combustion engine, such as a gasoline engine, a diesel engine, and a gas engine, of an automobile, e.g., a two-wheeled vehicle and a four-wheeled vehicle, a generator, a ship, etc.

[Friction Reduction Method of Internal Combustion Engine]

The friction reduction method of an internal combustion engine according to one embodiment of the present invention is a friction reduction method of an internal combustion engine including filling the aforementioned lubricating oil composition of the present invention in an internal combustion engine.

In accordance with the friction reduction method of an internal combustion engine according to one embodiment of the present invention, when the aforementioned lubricating oil composition of the present invention is filled in an internal combustion engine, the early friction reducing effect and the friction reduction maintaining effect are exhibited, and the fuel consumption becomes favorable.

[Production Method of Lubricating Oil Composition]

The production method of the lubricating oil composition of the present invention is not particularly limited.

For example, the production method of the lubricating oil composition according to one embodiment of the present invention includes a step of performing preparation of a lubricating oil composition containing a base oil (A), a molybdenum dithiocarbamate (B), an ester-based ashless friction modifier (C), and a metal salicylate (D), the preparation being performed so as to satisfy the following requirements (1) to (4).

Requirement (1): The content of a molybdenum atom derived from the molybdenum dithiocarbamate (B) is 650 ppm by mass or more on the basis of the whole amount of the lubricating oil composition.

Requirement (2): A content ratio [$C/B_{Mo}$] of the ester-based ashless friction modifier (C) to a molybdenum atom derived from the molybdenum dithiocarbamate (B) is 5.0 to 10 in terms of a mass ratio.

Requirement (3): The content of a salicylate soap group derived from the metal salicylate (D) is 0.50% by mass or more on the basis of the whole amount of the lubricating oil composition.

Requirement (4): A 100° C. kinematic viscosity is 4.0 $mm^2/s$ or more and less than 9.3 $mm^2/s$, and a high-temperature high-shear viscosity at 150° C. is 1.7 mPa·s or more and less than 2.9 mPa·s.

Although the method of mixing the aforementioned respective components is not particularly limited, for example, there is exemplified a method including a step of blending the base oil (A) with the component (B), the component (C), and the component (D). In addition, the aforementioned other additive for lubricating oil may also be simultaneously blended together with the components (A) to (D). In addition, each of the components may be blended in a form of a solution (dispersion) upon addition of a diluent oil or the like. It is preferred that after blending the respective components, the blend is stirred and uniformly dispersed by a known method.

EXAMPLES

The present invention is hereunder described more specifically by reference to Examples, but it should be construed that the present invention is not limited by the following Examples.

[Measurement of Respective Properties]

In this specification, properties of each of the raw materials used in each of the Examples and Comparative Examples and the lubricating oil composition of each of the Examples and Comparative Examples were measured in the following manners.

<Contents of Calcium Atom, Magnesium Atom, and Molybdenum Atom>

The contents of the foregoing atoms were each measured in conformity with ASTM D4951.

<100° C. Kinematic Viscosity and Viscosity Index>

The 100° C. kinematic viscosity and the viscosity index were measured with a glass-made capillary viscometer and calculated in conformity with JIS K2283:2000.

<HTHS Viscosity at 150° C.>

The HTHS viscosity was measured with a TBS high-temperature viscometer (tapered bearing simulator) under a temperature condition at 150° C. and at a shear rate of $10^6/s$ in conformity with ASTM D4683.

Examples 1 to 5 and Comparative Examples 1 to 4

The base oil and various additives shown below were added in blending amounts (unit: mass %) shown in Table 1 and then thoroughly mixed, thereby preparing lubricating oil compositions, respectively. All of the lubricating oil compositions were prepared such that the NOACK value was 14.0% by mass.

Details of the base oil and the various additives used in Examples 1 to 5 and Comparative Examples 1 to 4 are shown below.

<Base Oil (A)>

A mineral oil base oil having a 100° C. kinematic viscosity of 4 $mm^2/s$ and classified into Group 3 of the API classification was used.

<Molybdenum Dithiocarbamate (B)>

Molybdenum dialkyldithiocarbamate compound

<Ashless Friction Modifier>

Ester-based ashless friction modifier (C): Oleic acid glyceride

Ether-based ashless friction modifier: Alkyl ether derivative

Amine-based ashless friction modifier: Alkylamine derivative

<Metallic Detergent>

(Metal Salicylate (D))

Ca salicylate (D1-1)

Soap group ratio: 30% by mass, base number: 320 mgKOH/g Ca salicylate (D1-2)

Soap group ratio: 50% by mass, base number: 226 mgKOH/g Mg salicylate (D2)

Soap group ratio: 30% by mass, base number: 346 mgKOH/g (Other Metallic Detergent than Metal Salicylate (D))

Mg Sulfonate

Soap group ratio: 30% by mass, base number: 397 mgKOH/g

<Viscosity Index Improver>

A polymethacrylate was used.

The blending amount described in Table 1 is the content expressed in terms of a resin component (solid component).

<Other Additive for Lubricating Oil>

A mixture of a boron-containing alkenyl succinimide, a boron-free alkenyl succinimide, a zinc dialkyldithiophosphate, a phenol-based antioxidant, and an amine-based antioxidant

[Evaluation Methods]

The evaluation methods of the lubricating oil composition of each of the Examples and each of the Comparative Examples are as follows.

<Evaluation of Coefficient of Friction>

The coefficient of friction was measured with an MTM (mini traction machine) testing machine under the following condition.

Testing machine: MTM (mini traction machine), manufactured by PCS Instruments

Test piece: Standard test piece (AISI52100)

Load: 10 N

Oil temperature: 100° C.

Slide-roll ratio (SRR): 50%

Rubbing condition: Rolling speed, 100 mm/s; sliding speed, 50 mm/s

Evaluation condition of coefficient of friction: Rolling speed, 5 mm/s; sliding speed, 2.5 mm/s The measurement of the coefficient of friction was carried out immediately after commencement of test (0 minute) and after elapsing 10 minutes, 20 minutes, 30 minutes, 60 minutes, 90 minutes, 120 minutes, 180 minutes, and 240 minutes, respectively according to the rubbing time.

The evaluation was made according to the following evaluation criteria.

(Early Friction Reducing Effect)

The evaluation was made on the basis of the following criteria while making the coefficient of friction after elapsing 30 minutes as an index.

Evaluation A: 0.050 or less

Evaluation F: More than 0.050

(Friction Reduction Maintaining Effect)

The evaluation was made on the basis of the following criteria while making the coefficient of friction after elapsing 240 minutes as an index.

Evaluation A: 0.040 or less

Evaluation B: More than 0.040 and 0.050 or less

Evaluation F: More than 0.050

The results are shown in Table 1.

TABLE 1

| | | | Example 1 | Example 2 | Example 3 | Example 4 | Example 5 |
|---|---|---|---|---|---|---|---|
| Base oil (A) | | | Remainder | Remainder | Remainder | Remainder | Remainder |
| Molybdenum dithiocarbamate (B) | | | 0.70 | 0.70 | 0.70 | 0.70 | 0.70 |
| Ashless friction modifier | Ester-based ashless friction modifier (C) | | 0.50 | 0.50 | 0.50 | 0.50 | 0.50 |
| | Ether-based ashless friction modifier | | — | — | — | — | — |
| | Amine-based ashless friction modifier | | — | — | — | — | — |
| Metallic detergent | Metal salicylate (D) | Ca salicylate (D-1) | 1.07 | 1.07 | 1.07 | — | — |
| | | Ca salicylate (D-2) | — | — | — | 1.67 | 1.67 |
| | | Mg salicylate (D2) | 0.94 | 0.94 | 0.94 | 0.94 | — |
| | Other metallic detergent than metal salicylate (D) | Mg sulfonate | — | — | — | — | 0.76 |
| Viscosity index improver | | | 0.00 | 0.10 | 1.10 | 0.00 | 0.00 |
| Other additive | | | 7.70 | 7.70 | 7.70 | 7.70 | 7.70 |
| Total | | | 100 | 100 | 100 | 100 | 100 |
| Atom content | Ca (unit: ppm by mass) | | 1300 | 1300 | 1300 | 1300 | 1300 |
| | Mg (unit: ppm by mass) | | 700 | 700 | 700 | 700 | 700 |
| | Mo (unit: ppm by mass) | | 700 | 700 | 700 | 700 | 700 |
| [(Ashless friction modifier (C))/(Mo atom derived from molybdenum dithiocarbamate (B))] [$C/B_{Mo}$] | | | 7.14 | 7.14 | 7.14 | 7.14 | 7.14 |
| Salicylate soap group (unit: mass %) | | | 0.60 | 0.60 | 0.60 | 1.12 | 0.84 |
| Properties | 100° C. kinematic viscosity (unit: $mm^2/s$) | | 4.9 | 5.1 | 6.9 | 4.9 | 4.9 |
| | Viscosity index | | 143 | 150 | 197 | 143 | 143 |
| | HTHS viscosity at 150° C. (unit: mPa · s) | | 1.8 | 1.8 | 2.3 | 1.8 | 1.8 |
| | Rubbing Time [mm] | Rolling Speed [mm/s] | Sliding Speed [mm/s] | | | | |
| Coefficient of friction in MTM friction test | 0 | 5.00 | 2.50 | 0.123 | 0.116 | 0.117 | 0.124 | 0.120 |
| | 10 | 5.00 | 2.50 | 0.067 | 0.091 | 0.090 | 0.064 | 0.079 |
| | 20 | 5.00 | 2.50 | 0.046 | 0.054 | 0.055 | 0.040 | 0.050 |
| | 30 | 5.00 | 2.50 | 0.041 | 0.042 | 0.048 | 0.037 | 0.040 |
| | 60 | 5.00 | 2.50 | 0.040 | 0.037 | 0.038 | 0.038 | 0.046 |
| | 90 | 5.00 | 2.50 | 0.037 | 0.037 | 0.036 | 0.039 | 0.037 |
| | 120 | 5.00 | 2.50 | 0.036 | 0.037 | 0.037 | 0.041 | 0.043 |
| | 180 | 5.00 | 2.50 | 0.037 | 0.040 | 0.036 | 0.042 | 0.046 |
| | 240 | 5.00 | 2.50 | 0.036 | 0.036 | 0.036 | 0.042 | 0.046 |
| | Early friction reduction effect | | | A | A | A | A | A |
| | Friction reduction maintaining effect | | | A | A | A | B | B |

| | | | Comparative Example 1 | Comparative Example 2 | Comparative Example 3 | Comparative Example 4 |
|---|---|---|---|---|---|---|
| Base oil (A) | | | Remainder | Remainder | Remainder | Remainder |
| Molybdenum dithiocarbamate (B) | | | 0.60 | 0.70 | 0.70 | 0.70 |
| Ashless friction modifier | Ester-based ashless friction modifier (C) | | 0.50 | — | — | 0.50 |
| | Ether-based ashless friction modifier | | — | 0.50 | — | — |
| | Amine-based ashless friction modifier | | — | — | 0.50 | — |
| Metallic detergent | Metal salicylate (D) | Ca salicylate (D-1) | 1.07 | 1.07 | 1.07 | 1.07 |
| | | Ca salicylate (D-2) | — | — | — | — |
| | | Mg salicylate (D2) | 0.94 | 0.94 | 0.94 | — |
| | Other metallic detergent than metal salicylate (D) | Mg sulfonate | — | — | — | 0.76 |

TABLE 1-continued

| | | | | | | | |
|---|---|---|---|---|---|---|---|
| Viscosity index improver | | | | | 1.10 | 0.10 | 0.10 | 0.10 |
| Other additive | | | | | 7.70 | 7.70 | 7.70 | 7.70 |
| Total | | | | | 100 | 100 | 100 | 100 |
| Atom content | Ca (unit: ppm by mass) | | | | 1300 | 1300 | 1300 | 1300 |
| | Mg (unit: ppm by mass) | | | | 700 | 700 | 700 | 700 |
| | Mo (unit: ppm by mass) | | | | 600 | 700 | 700 | 700 |
| [(Ashless friction modifier (C))/(Mo atom derived from molybdenum dithiocarbamate (B))] [$C/B_{Mo}$] | | | | | 8.33 | 7.14 | 7.14 | 7.14 |
| Salicylate soap group (unit: mass %) | | | | | 0.60 | 0.60 | 0.60 | 0.32 |
| Properties | 100° C. kinematic viscosity (unit: $mm^2/s$) | | | | 6.9 | 5.1 | 5.1 | 5.1 |
| | Viscosity index | | | | 197 | 150 | 150 | 150 |
| | HTHS viscosity at 150° C. (unit: mPa · s) | | | | 2.3 | 1.8 | 1.8 | 1.8 |
| | Rubbing Time [mm] | Rolling Speed [mm/s] | Sliding Speed [mm/s] | | | | | |
| Coefficient of friction in MTM friction test | 0 | 5.00 | 2.50 | | 0.124 | 0.132 | 0.096 | 0.121 |
| | 10 | 5.00 | 2.50 | | 0.097 | 0.109 | 0.086 | 0.128 |
| | 20 | 5.00 | 2.50 | | 0.067 | 0.068 | 0.088 | 0.075 |
| | 30 | 5.00 | 2.50 | | 0.056 | 0.058 | 0.089 | 0.069 |
| | 60 | 5.00 | 2.50 | | 0.043 | 0.051 | 0.058 | 0.041 |
| | 90 | 5.00 | 2.50 | | 0.044 | 0.040 | 0.039 | 0.035 |
| | 120 | 5.00 | 2.50 | | 0.042 | 0.035 | 0.038 | 0.035 |
| | 180 | 5.00 | 2.50 | | 0.040 | 0.042 | 0.038 | 0.037 |
| | 240 | 5.00 | 2.50 | | 0.036 | 0.046 | 0.047 | 0.033 |
| | Early friction reduction effect | | | | F | F | F | F |
| | Friction reduction maintaining effect | | | | A | B | B | A |

The following is understood from the results shown in Table 1.

It is noted that the lubricating oil compositions of Examples 1 to 5 exhibit both the early friction reducing effect and the friction reduction maintaining effect. In addition, it is noted that the lubricating oil compositions of Examples 1 to 3 are more excellent with respect to the friction reduction maintaining effect.

In contrast, in the lubricating oil compositions of Comparative Examples 1 to 4, the early friction reducing effect is not exhibited, and the friction reducing effect is exhibited significantly delayed as compared with that in Examples 1 to 5, and as a result, it is noted that the coefficient of friction 240 minutes after commencement of test is reduced.

What is claimed is:

1. A lubricating oil composition comprising a base oil (A), a molybdenum dithiocarbamate (B), 0.30% to 0.70% by mass of an ester-based ashless friction modifier (C), and a metal salicylate (D), wherein the content of a molybdenum atom derived from the molybdenum dithiocarbamate (B) is 680 ppm to 800 ppm by mass on the basis of the whole amount of the lubricating oil composition;

a content ratio [$C/B_{Mo}$] of the ester-based ashless friction modifier (C) to a molybdenum atom derived from the molybdenum dithiocarbamate (B) is 5.0 to 10 in terms of a mass ratio;

the content of a salicylate soap group derived from the metal salicylate (D) is 0.55% to 0.80% by mass on the basis of the whole amount of the lubricating oil composition; and the ester-based ashless friction modifier (C) is selected from the group consisting of glycerin fatty acid monoester and glycerin fatty acid diester, the metal salicylate (D) is selected from the group consisting of calcium salicylate (D1) and magnesium salicylate (D2) each having a base number of 200 to 500 mgKOH/g, and a kinematic viscosity at 100° C. of the lubricating oil composition is 4.0 $mm^2/s$ or more and less than 9.3 $mm^2/s$, and a high-temperature high-shear viscosity at 150° C. of the lubricating oil composition is 1.7 mPa·s or more and less than 2.9 mPa·s.

2. The lubricating oil composition according to claim 1, wherein the content of a calcium atom derived from the calcium salicylate (D1) is 1,200 to 1,400 ppm by mass on the basis of the whole amount of the lubricating oil composition.

3. The lubricating oil composition according to claim 1, wherein the content of a magnesium atom derived from the magnesium salicylate (D2) is 700 to 800 ppm by mass on the basis of the whole amount of the lubricating oil composition.

4. The lubricating oil composition according to claim 1, wherein a NOACK value is 15.0% by mass or less.

5. The lubricating oil composition according to claim 1, further comprising a viscosity index improver; wherein a content of a resin component derived from the viscosity index improver is 2% by mass or less on the basis of the whole amount of the lubricating oil composition.

6. A lubricating oil composition comprising the lubricating oil composition according to claim 1, wherein the lubricating oil composition is suitable to lubricate parts of an internal combustion engine.

* * * * *